US011724294B2

(12) United States Patent
Dorigo

(10) Patent No.: US 11,724,294 B2
(45) Date of Patent: Aug. 15, 2023

(54) BENDING AND SHIFTING SYSTEM FOR ROLLING MILL STANDS

(71) Applicant: DANIELI & C. OFFICINE MECCANICHE S.p.A., Buttrio (IT)

(72) Inventor: Andrea Dorigo, Manzano (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 94 days.

(21) Appl. No.: 17/421,298

(22) PCT Filed: Jan. 17, 2020

(86) PCT No.: PCT/IB2020/050363

§ 371 (c)(1),
(2) Date: Jul. 7, 2021

(87) PCT Pub. No.: WO2020/148710

PCT Pub. Date: Jul. 23, 2020

(65) Prior Publication Data

US 2022/0118493 A1 Apr. 21, 2022

(30) Foreign Application Priority Data

Jan. 17, 2019 (IT) ..... 102019000000713

(51) Int. Cl.
*B21B 31/18* (2006.01)
*B21B 31/22* (2006.01)
*B21B 29/00* (2006.01)

(52) U.S. Cl.
CPC ..... *B21B 31/22* (2013.01); *B21B 29/00* (2013.01)

(58) Field of Classification Search
CPC ..... B21B 13/14; B21B 13/142; B21B 13/18; B21B 29/00; B21B 31/18; B21B 31/203;
(Continued)

(56) References Cited

U.S. PATENT DOCUMENTS 4,543,810 A * 10/1985 Stoy ..... B21B 31/18 72/241.8
4,967,582 A * 11/1990 Bohnenkamp ..... B21B 31/18 72/247

(Continued)

FOREIGN PATENT DOCUMENTS

JP S59130607 A 7/1984
WO WO2010034481 A2 4/2010

OTHER PUBLICATIONS

Patent Cooperation Treaty, International Search Report and Written Opinion for International Application No. PCT/IB2020/050363, dated May 26, 2020, 10 pages.

*Primary Examiner* — Edward T Tolan
(74) *Attorney, Agent, or Firm* — Stetina Brunda Garred and Brucker

(57) ABSTRACT

The rolling mill stand comprises a bending device and a shifting device for the rolling rolls. The housing supports the upper backing and work rolls, and the lower backing and work roll and comprises the lower bending block, the upper bending block, the chock of the upper work roll, the chock of the lower work roll, the axial shifting device of the upper work roll, the axial shifting device of the lower work roll. The chock of the lower work roll is coupled with the lower bending block to transmit a bending load on the lower work roll. The upper bending block transmits a bending load on the upper work roll by means of the action of actuators. The bending block comprises a slide with a T-section which slides in the guide and a chock of the upper backing roll, whereby the upper bending block, instead of being a single piece, is formed by two different and separate structural components.

6 Claims, 4 Drawing Sheets

(58) Field of Classification Search
CPC . B21B 31/22; B21B 2269/04; B21B 2269/14; B21B 2013/025
See application file for complete search history.

(56) References Cited

U.S. PATENT DOCUMENTS

| | | | | |
|---|---|---|---|---|
| 6,112,569 | A * | 9/2000 | Ossendorf | B21B 29/00 72/241.8 |
| 7,895,871 | B2 * | 3/2011 | Zieser | B21B 29/00 72/241.8 |
| 9,308,562 | B2 * | 4/2016 | Diehl | B21B 29/00 |
| 9,802,231 | B2 * | 10/2017 | Fuchs | B21B 29/00 |

* cited by examiner

BENDING AND SHIFTING SYSTEM FOR ROLLING MILL STANDS

CROSS-REFERENCE TO RELATED APPLICATIONS

This application claims priority to PCT International Application No. PCT/IB2020/050363 filed on Jan. 17, 2020, which application claims priority to Italian Patent Application No. 102019000000713 filed on Jan. 17, 2019, the disclosures of which are expressly incorporated herein by reference.

STATEMENT RE: FEDERALLY SPONSORED RESEARCH/DEVELOPMENT

Not applicable.

BACKGROUND OF THE INVENTION

Field of the Invention

The present invention relates to the field of rolling plane metal products, in particular, to rolling mill stands.

Background Art

Rolling mill stands for rolling flat products, for example sheet metal, having combined systems are known which allow the translation of work rolls under load, i.e. shifting, while, at the same time, the straightening (or bending) load is applied to the chocks of the work rolls, even in case a large opening must be ensured between the work rolls in a rolling mill stand. In particular, in rolling mill stands requiring large openings between the work cylinders for rolling large product thicknesses, high reaction forces are discharged onto the structure of the rolling mill stands, caused by the high rolling forces which must be applied to the material which is rolled, with the possible bending of the rolls. Therefore, such systems employ bending blocks to impart to the work cylinders a curvature of inclination which is opposite and positive with respect to that produced when the rolling forces are applied. Therefore, said blocks, by virtue of the action of hydraulic pistons, manage to contrast the curvature produced by the reaction to the force applied to the product to be rolled which, otherwise, would deform assuming a lenticular sectional shape. The bending blocks defined as "positive" apply a load on the chocks of the work rolls so that the chocks of the lower work roll are moved away from the chocks of the upper work rolls by exploiting the reaction to the deformation which the work rolls receive from the backing rolls and, as a result thereof, the work rolls tend to take on a shape such as to contrast the natural deformation thereof under the rolling load with the consequence of limiting or canceling the lenticular cross-sectional shape which the rolled product exiting the stand tends to take on.

Employing a shifting, i.e. the axial translation of the work rolls, in a rolling mill stand of the aforementioned type is also known, so as to distribute the wear of the work cylinders itself in the direction of the axial length. Such wear occurs at the colder edges of the rolled band in the event of a rolling series on metal products of the same width. The application of the shifting allows, during the rolling operation, moving the rolling rolls in a direction transversal to the rolling axis so that the portion of surface of the rolls which works in contact with the areas of the lateral edges of the rolling material at a lower temperature is not always the same, but varies during the operation.

On the other hand, the shifting also allows better controlling the product output thickness in the event that cylinders with non-rectilinear profiles are used, and to reduce the occurrence of grooves or other surface defects and therefore to extend the life of the rolling rolls.

In particular, for flat products rolling lines, in which the initial thickness of the slabs to be rolled may be greater than 300 mm, the bending blocks are not made as a single block bolted to the housing of the rolling mill stand, but a widely used solution is one in which the upper bending block is bolted to the upper backing chock, while the lower bending block remains bolted to the housing.

In rolling mill stands, the offset between the work roll and the backing roll is generally applied to stabilize the rolls themselves during the application of the rolling force, but an issue associated with this arrangement, in which the upper bending block is fixed to the chock of the upper backing roll, is that the offset applied between the upper work roll and the upper backing roll is not effective, since the force generated by the bending block only stabilizes the work roll with respect to the backing roll, while the assembly consisting of the work roll and the backing roll is free to cross over even during the rolling.

Another issue is that installing the shifting system on the chock of the upper backing roll is difficult, as well as more expensive, since the spare chocks of the upper backing rolls should mount a shifting device even when they are not mounted on the rolling mill stand, which entails the need to install additional shifting blocks, with an increase in costs.

The known solutions with bending blocks bolted to the housing are however limited since the stand opening capacity, intended as the maximum distance between the work rolls, for geometric reasons, only reaches about 350 mm.

The solution disclosed in WO2012017072A1, which aims to partially solve the aforementioned issues, remains however limited in the maximum opening of the stand which, for geometric reasons, reaches a maximum of 650 mm. In fact, due to the reduced spaces existing between the components inserted in the housings of the stand, it is not possible to use bending cylinders with high vertical strokes to produce a large opening. Furthermore, even if longer rods were used, issues in guiding the cylinders would occur, since the risk of deflection of the rods themselves would increase.

Therefore, the need to create a rolling mill stand having a bending and shifting system which solves the aforesaid issues and has the possibility of increasing the maximum opening capacity between the work rolls at limited costs is felt. Furthermore, the creation of a rolling mill stand which is not of complicated construction is also intended to facilitate the assembly and disassembly of the various constituent parts.

SUMMARY OF THE INVENTION

These objects just mentioned, as well as other objects, which will become more apparent in the light of the following description, are achieved by means of a rolling mill stand comprising two or more upper rolling rolls, one roll forming an upper work roll and two or more lower rolling rolls, one roll forming a lower work roll and comprising two housings, each housing being arranged at a respective axial end of said rolling rolls, in which at a first of said two housings there are provided two lower bending blocks and two upper bending blocks, fixed to said first housing, a chock of the upper work roll and a chock of the lower work roll, a chock of the upper backing roll and a chock of the lower backing roll, an axial shifting device of the upper work roll to produce a first horizontal translational movement of the upper work roll in a direction parallel to the axis thereof, an axial shifting device of the lower work roll to produce a second horizontal translational movement of the lower work roll in a direction parallel to the axis in which the chock of the lower work roll is constrained to the lower bending block by means of a first vertical sliding coupling allowing said chock of the lower work roll to perform vertical movements, in which each of the two upper bending blocks is a different structural element separated from the chock of the upper backing roll and comprises a first part which forms a second vertical sliding coupling with a respective guide fixed on said first housing, and a second part which forms an element for supporting the chock of the upper backing roll and the chock of the upper work roll, so that the chock of the upper backing roll and the chock of the upper work roll are constrained together to the two upper bending blocks allowing the integral lifting and lowering thereof.

The bending and shifting system of the rolling rolls present in the rolling mill stand of the invention, by virtue of such features, is more easily manageable and manipulable since the upper bending block is supported and controlled in the lifting and lowering movements thereof by the upper backing roll chock itself which, in the event of the complete replacement thereof together with the work roll and the backing roll, does not also require the disassembly of the balancing crosspiece which may remain in the place thereof in the stand.

Furthermore, by virtue of the fixing of the shifting block on the bending block instead of directly on the chock of the work roll or on the housing of the stand, there is the advantage that also the shifting block is fixed on an element which is integral with the stand and, when the stand work rolls replacement operation occurs, it does not need to be detached from the housing or from an element which remains attached to the housing. This avoids having additional sets of shifting blocks to be managed outside of the stand together with the work rolls, which would entail an increase in the number of spare shifting blocks to be set up in the rolling plant and an increase in the management costs of the stand.

A further advantage of the invention derives from the sliding fixing of the bending block in the lateral guides with a T-section, which allow the chock of the work and backing rolls to move in a vertical direction, and at the same time avoid the detachment of the bending block from the housing of the rolling mill stand when the work roll and/or the backing roll are replaced.

Other particular embodiments of the stand of the invention are described in the dependent claims.

BRIEF DESCRIPTION OF THE FIGURES

Further objects and advantages of the present invention will become more apparent from the following detailed description of an embodiment thereof and from the accompanying drawings, merely given by way of explanation and not by way of limitation, in which.

The same reference numbers and the same reference letters in the Figures identify the same elements or components.

DETAILED DESCRIPTION OF PREFERRED EMBODIMENTS OF THE INVENTION

Figure 1:
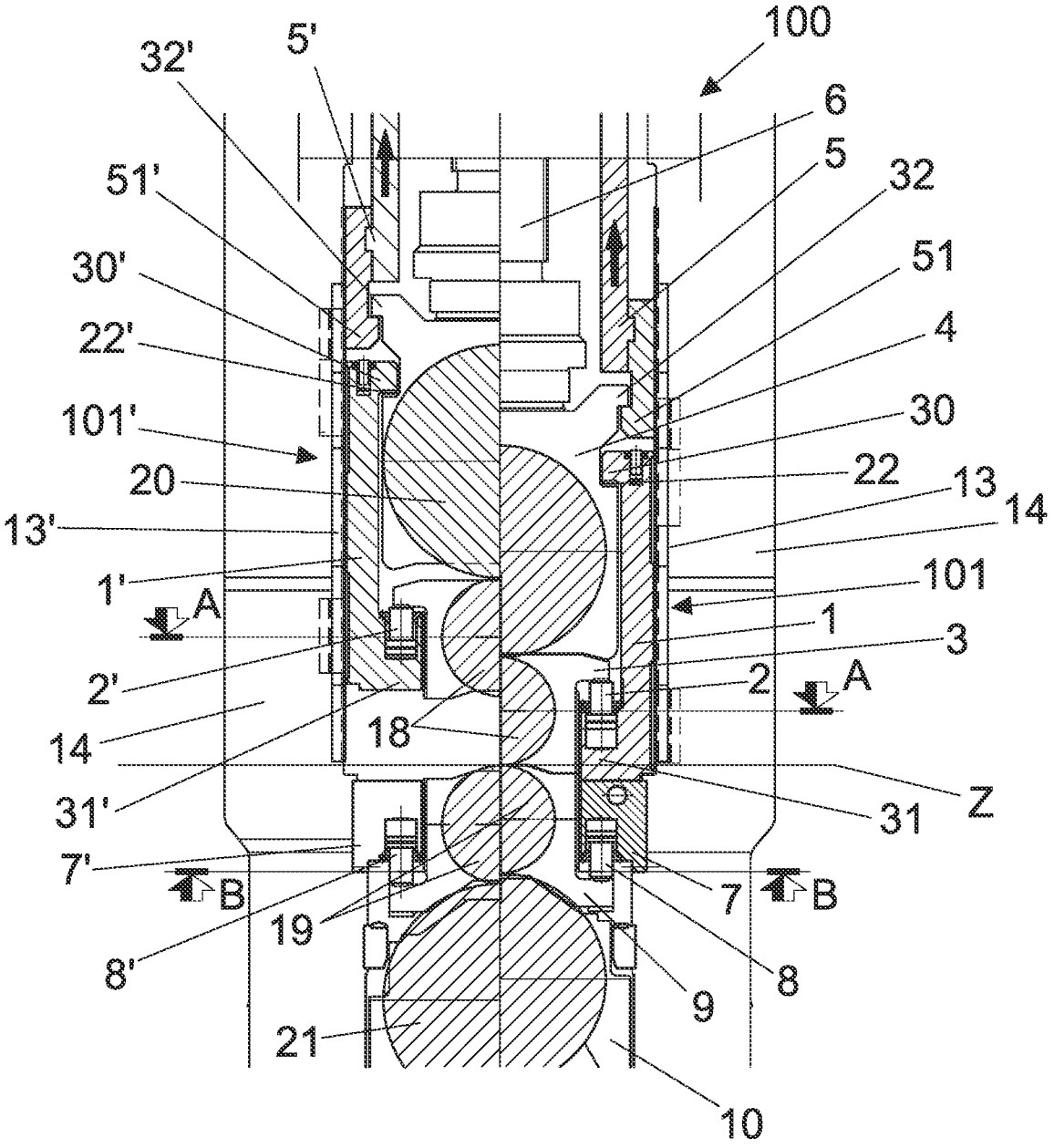
FIG. 1 shows a vertical plane section of a rolling mill stand of the invention.
Figure 2:
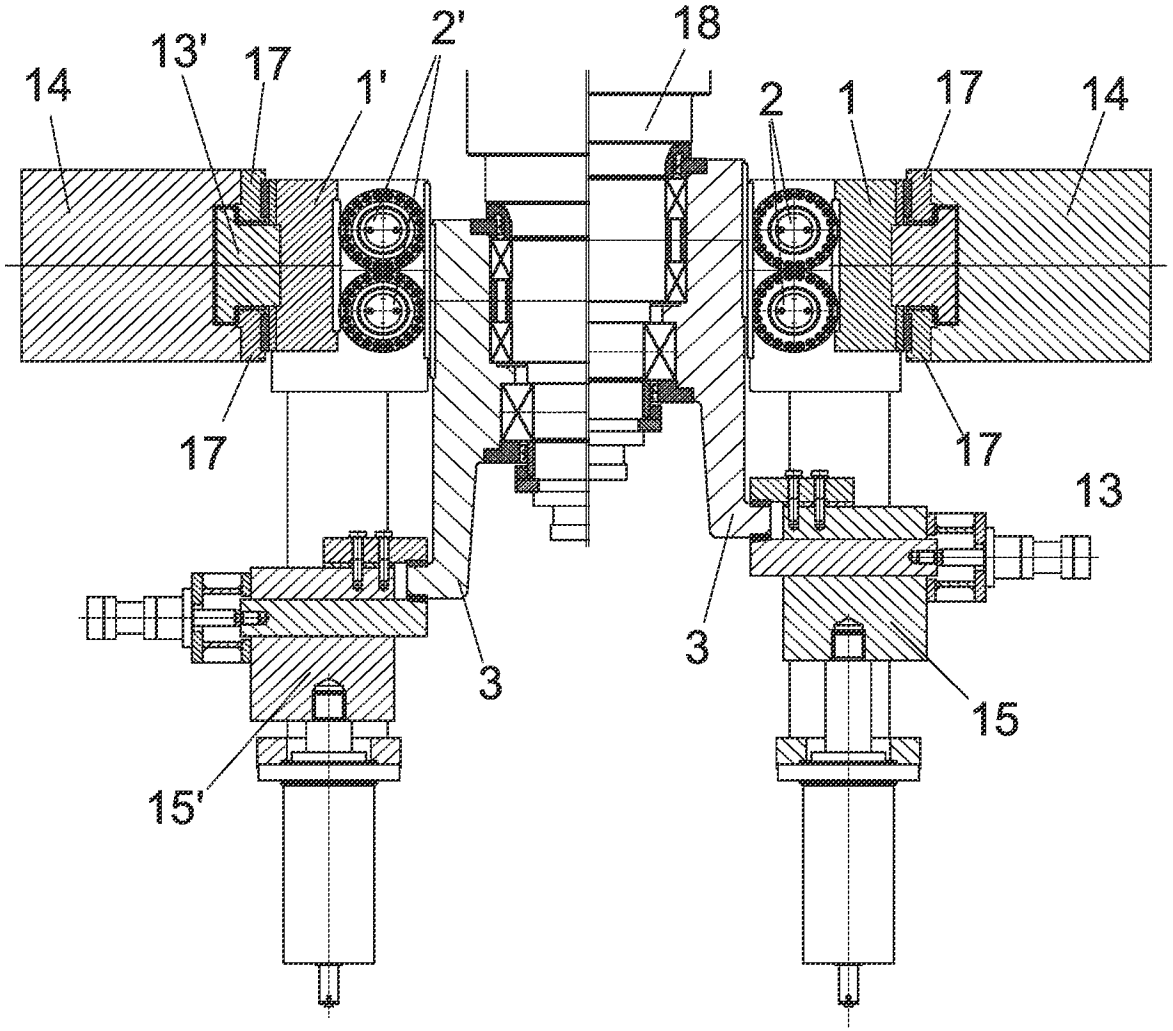
FIG. 2 shows a sectional view of the upper work roll according to the broken axis A-A of FIG. 1 in which the view of the left half shows a work position different from the position shown in the view of the right half.
Figure 3:
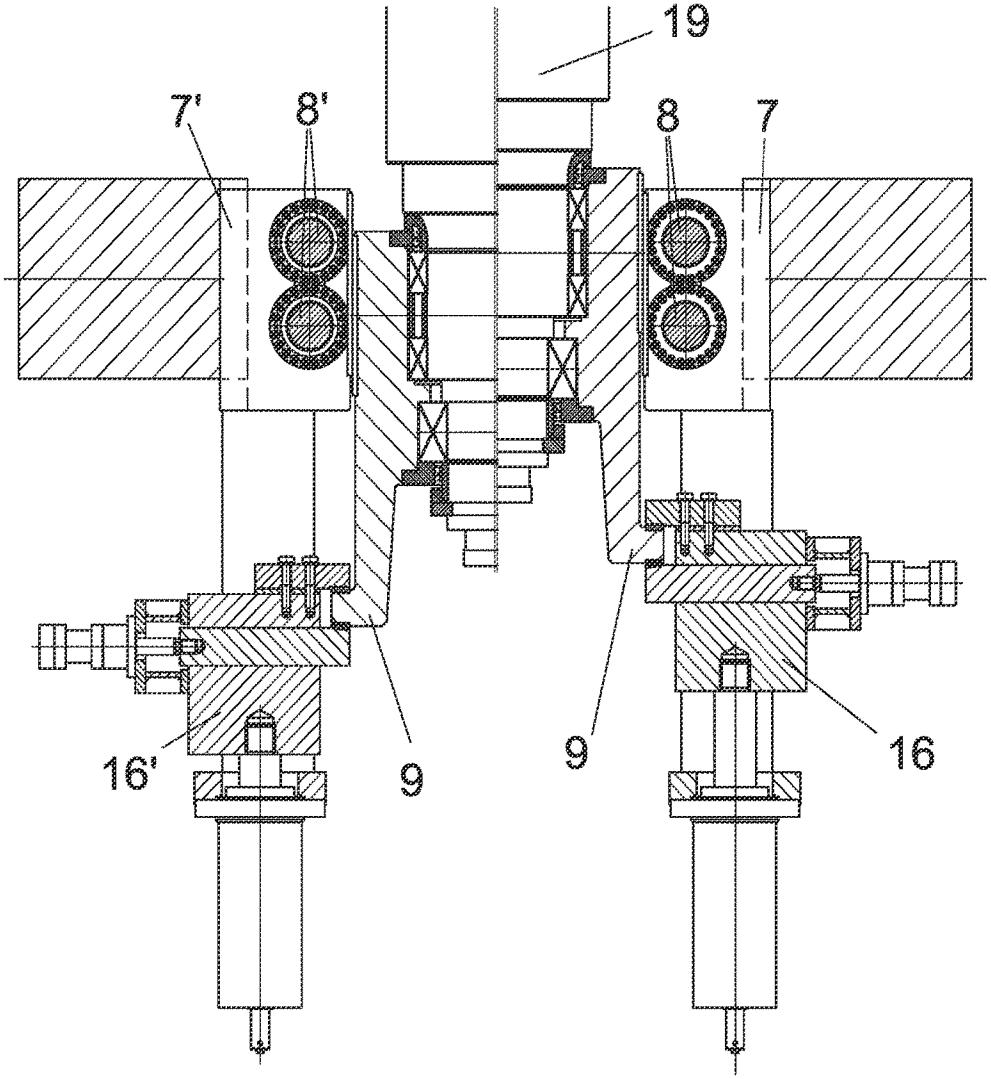
FIG. 3 shows a sectional view of the lower work roll according to the broken axis B-B of FIG. 1 in which the view of the left half shows a work position different from the position shown in the view of the right half.

With reference to the Figures, a rolling mill stand, which is arranged transversely with respect to the rolling direction Z, has been generally indicated with reference numeral 100. The rolling mill stand is of the quadruple type with two work rolls, the upper work roll 18 and the lower work roll 19, and is provided with two backing rolls: the upper one 20 and the lower one 21, of a diameter greater with respect to the one of the work rolls. With reference to FIG. 1, FIG. 2 and FIG. 3, in the description, exclusively for convenience of explanation, reference is made to a single side of the rolling mill stand 100, the one facing the operator. The part of the stand which is not shown in the Figures of the motor part is made up of similar elements, except for the absence, in particular, of the shifting elements, and provided that in the following description it is not otherwise and expressly specified.

The rolling mill stand 100 has two housings of which only the housing 14 is shown in the Figures, for reasons of simplicity and explanatory clarity, but it is apparent to the person skilled in the art that at the opposite end of the rolls, not shown in the Figures, the one on the motor side, a second housing is arranged symmetrically with respect to the rolling direction Z and with a similar structure, which, although, as mentioned above, does not provide for the presence of shifting devices, which are only necessary on one side of the stand.

The backing rolls may also be more than two, as is well known to the person skilled in the art, depending on the type of rolling mill stand considered, without thereby departing from the scope of the invention. Each of the work rolls 18, 19 and of the backing rolls 20, 21 defines a rotation axis thereof which is orthogonal, or at least substantially orthogonal, to the rolling direction. The rolling product may be a metal band, or a metal product of a greater thickness, such as for example a slab, in particular, but not exclusively, made of steel.

The two upper bending blocks 101, 101' are fixed on the housing 14 on opposite sides of the axes of the rolls in a sliding manner by means of the respective sliding couplings 13, 13', in particular sliding slides, which cross-section is T-shaped (FIG. 2), which allows the sliding thereof in the respective guide only in the vertical direction to follow the lifting and lowering movements controlled by the valve 6 and prevents the slides 13, 13' from coming out of the respective guides, when the chocks 3, 4 of the upper rolls are outside the housing 14, for example, during an upper rolls replacement operation. The two guides 17, 17' inside which the slides 13, 13' slide, are fixed on the respective uprights of the housing 14 by means of threaded fixing elements, such as screws and bolts. When the backing roll 20 and the work roll 18 are disassembled to be replaced, the two upper bending blocks 101, 101' are not detached and extracted from the housing 14 of the stand, but may remain fixed on the housing 14 itself by virtue of the sectional T-shape of the guides 17, which prevent the extraction thereof, if not in the event of necessity.

The upper chock 3 backs the upper work roll 18 at one axial end thereof, in a manner known to the person skilled in the art, and may slide vertically with respect to the housing 14, together with the upper bending blocks 101, 101', as already explained above. The two upper bending blocks 101, 101' are advantageously formed by two parts or structural components 1 and 13, 1' and 13' mounted together by means of fixing means of the known type, e.g. screws. With this construction, the upper bending blocks 101 and 101' are formed by at least two structural components 1 and 13, 1' and 13', which are distinct and separate instead of being a single piece as in other solutions of the known background art.

Due to the presence of the two upper 30 and lower projections 31 in the structural component 1 and of the two upper projections 30' and 31' in the structural component 1', these two structural components 1 and 1', in a side view, have an approximately straight and overturned C shape depending on the side from which it is observed, as visible in FIG. 1. Thereby, the structural components 1 and 1' of the two bending blocks 101, 101' connect the chock 3 of the upper work roll 18 with the chock 4 of the upper backing roll 20, and therefore the two chocks 3 and 4 may be integrally lifted or lowered together in a vertical direction, under the control of the valve 6 and the balancing device 5, 5'. In addition, the chock 3 of the upper work roll 18 may slide vertically, moving closer and further away with respect to the chock 4 of the upper backing roll 20, operating the four upper hydraulic bending pistons 2, 2'.

The upper bending blocks 101 and 101' are supported by the respective projections 30 and 30' which are inserted in respective grooves 22, 22' made on the sides of the chock 4 of the upper backing roll 20 and, thereby, the upper bending blocks 101, 101' may integrally move with the chock 4 and with the chock 3 to lift and lower them.

Two upper balancing crosspieces 5 and 5' directly back the projections 32, 32' obtained in the upper part of the chock 4 of the upper backing roll 20. Thereby, a vertical lifting or lowering of the balancing crosspieces 5, 5' involves a corresponding integral lifting or lowering of the chocks 3 and 4 and, therewith, of the work 18 and backing rolls 20, in accordance with the movements of the valve 6.

The bending blocks 101, 101' of the work 18 and backing rolls 20, by virtue of this direct backing of the projections 30 and 30' on the housings 22 and 22' of the chock 4 of the upper backing roll 20, instead of being directly hooked to the hooks 51 and 51' of the balancing crosspieces 5, 5', make the system more flexible, since, in the event that a complete replacement of the chock 4 of the upper backing roll 20 and/or of the chock 3 is carried out, disassembling the balancing crosspiece 5, 5', which may remain mounted on the rolling mill stand, is avoided, unless there is an actual need to disassemble the balancing crosspiece for other reasons.

Figure 4:
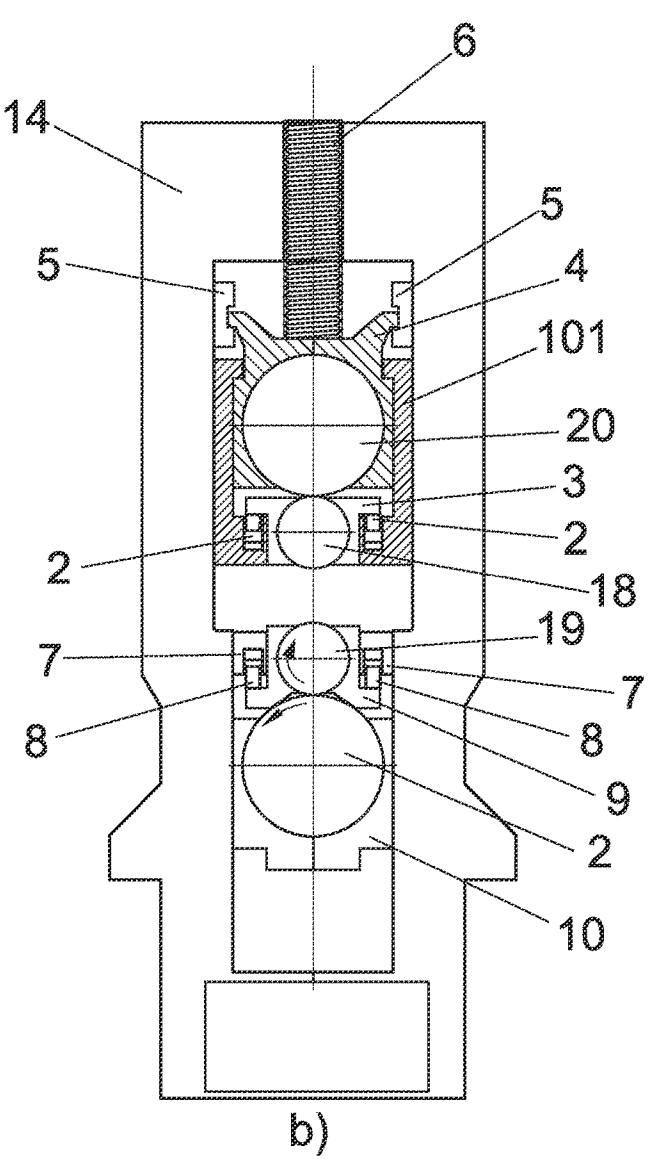
FIG. 4 shows the comparison between a diagram b) of the rolling mill stand in accordance with the invention and a diagram a) of a rolling mill stand of the background art shown in a respective side view.
Figure 4:
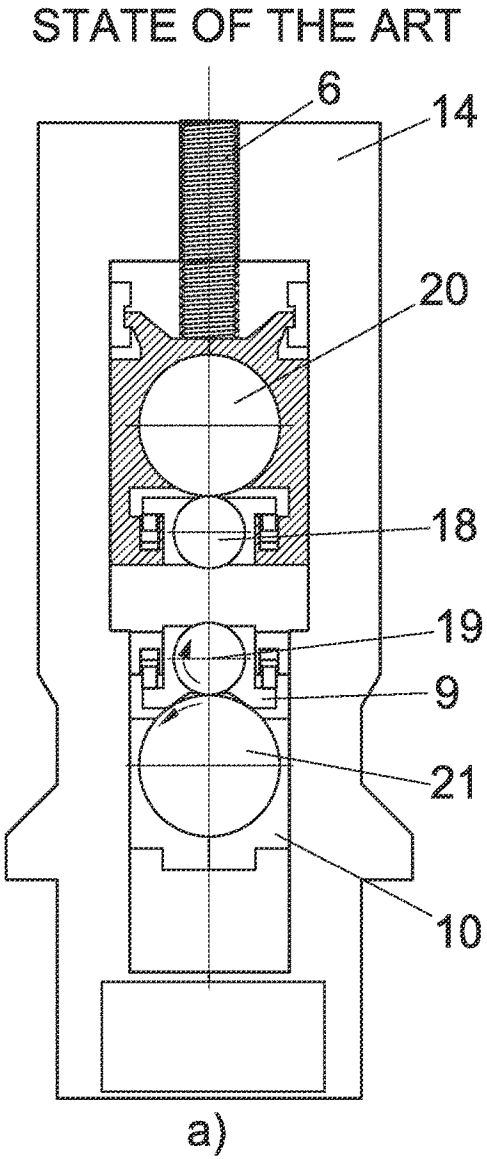

This advantageous solution is in accordance with the invention, in which the bending blocks 101, 101' are not made in a single piece with the chocks, as shown in the diagrammatic stand of the background art in FIG. 4, but are composed of two distinct and separate structural elements, splitting the two main functions that the bending blocks perform. One of the functions of the structural component 1, 1' is to be part of the chock 4 of the upper backing roll 20, while the function of the component 13, 13' is to create the sliding coupling on the other. This separation of the functions into separate structural elements ensures that the effect of stabilizing the offset is achieved since the upper backing roll 20 is pushed in the horizontal and opposite direction with respect to the offset while the upper work roll 18 is pushed in the horizontal and same direction with respect to the offset.

The rolling mill stand 100 comprises a total of four lower bending blocks of which the two bending blocks 7, 7', with the relative lower bending pistons 8, 8', are arranged on the housing 14, as better visible in FIGS. 1 and 3, and are associated with the lower work roll 19, which is supported at the axial end thereof by the chock 9. The two bending blocks 7, 7' are bolted to the housing 14, while the other two bending blocks, not shown in the FIGS. 1-3, are bolted to the housing of the motor side, not shown. The chock 10 of the lower backing roll 21 is arranged in the lower part of the housing 14 and supports the lower backing roll 21 at an axial end thereof.

To better understand the invention, the operation of the bending system of the rolling mill stand 100 is now explained, always only with reference to the housing 14 of the side viewed of the rolling mill stand. When the upper bending blocks 101, 101' are moved vertically upwards or downwards, such movement is also associated with the movement of the chock 4 of the upper backing roll 20 which backs it on the contact surface 22 together with the chock 3 of the work roll 18.

During the rolling steps, the chock 4 of the upper backing roll 20 is constantly kept in contact with the valve 6 by the operation of the balancing crosspiece 5, 5' which supports the chock 4 directly by means of the hooks 51, 51', while the work roll 18 is constantly kept in contact with the backing roll 20 by the action of the bending pistons 2, 2'. Therefore, the upper backing cylinder 20 with the relative chock 4, the component 1, 1', the work cylinder 18 with the relative chock 3 and the upper bending blocks 101, 101' with the relative pistons 2, 2', integrally move in a vertical direction downwards or upwards, following the movements controlled by the valve 6.

On the operator side of the rolling mill stand 100, there are the shifting blocks 15, 15' of the upper work cylinder 18, better shown in FIG. 2, which are horizontal axial translational systems of the work cylinders in a direction parallel to the axis thereof, and the shifting blocks 16, 16' of the lower work cylinder 19, better shown in FIG. 3. The two shifting blocks 15, 15' which act on the upper work cylinder 18 are integrally fixed directly to the two bending blocks 101, 101' of the upper backing roll 20, by means of the two structural elements or supporting arms 151, 151', instead of being fixed directly to the housing 14, as in rolling mill stands of the known type. By virtue of this fixing method, the horizontal translational movement of the upper work roll 18 in the direction of the axis thereof occurs with a relative movement between the chock 3 of the upper work roll 18 and the upper bending blocks 101, 101' and, by virtue of the solution in accordance with the invention, the shifting may be advantageously performed under load, while the rolling operation is in progress, without any interruption of the rolling.

The two lower shifting blocks 16, 16' which act on the lower work cylinder 19 may be fixed to the lower bending block 7, 7' or, alternatively, to the housing 14 itself. The horizontal translational movement of the lower work roll 19 occurs between the chock 9 of the lower work roll 19 and the lower bending block 7, 7' and may be performed under load while the rolling operation is in progress.

FIG. 3 shows the alternative embodiment of the invention in which the lower shifting blocks 16, 16' are integrally fixed directly to the lower bending block 7, 7' by means of the two structural elements or supporting arms 161, 161'.

By virtue of the invention, a positive bending on the work rolls combined with a shifting may be applied simultaneously to a rolling mill stand with a large opening (approximately 300 mm or greater), and the issues related to the instability of the roll pack of a rolling mill stand of the background art, in which the bending blocks are incorporated with the upper backing chock as a single piece, may be solved. Therefore, positive bending may be applied to the upper work cylinder even if the thickness of the product to be rolled exceeds 650 mm and shifting may also be applied for the same thickness intervals.

Another advantage of the rolling mill stand of the invention is that it is not necessary to extract the two bending blocks 101 and 101', seen in the Figures, and not even the corresponding ones on the motor side not shown in the Figures, from the rolling mill stand 100 when the replacement operation of the upper backing cylinder 20 occurs, conversely to what must be done with the background art solutions. Other known embodiments, in fact, entail the disadvantage of having to install upper bending blocks on all sets of chocks, i.e., both on the sets mounted on the stand and on all the spare sets.

Another advantage of the invention is that it may also mount the two shifting blocks 15, 15' on the same upper bending blocks 101, 101' which, as explained above, must not be extracted together with the upper work roll 18 when this is replaced, but remain fixed to the housing 14 of the rolling mill stand and therefore are not replaced, eliminating the need to also replace the shifting blocks 15, 15', reducing the number thereof necessary for the operation of the rolling mill stand. Furthermore, by virtue of the fixing mode of the shifting blocks 16, 16' of the lower work roll on the lower bending block 7, 7' the same advantage is obtained.

The invention claimed is:

1. A rolling mill stand comprising two or more upper rolling rolls, one roll forming an upper work roll and two or more lower rolling rolls, one roll forming a lower work roll and comprising two housings, each housing being arranged at a respective axial end of said rolling rolls, wherein, at a first of said two housings, there are provided two lower bending blocks and two upper bending blocks fixed to said first housing, a chock for the upper work roll and a chock for the lower work roll, a chock for the upper backing roll and a chock for the lower backing roll, a first axial shifting device for the upper work roll to produce a first horizontal translational movement of the upper work roll in a direction parallel to the axis thereof, a second axial shifting device for the lower work roll to produce a second horizontal translational movement of the lower work roll in a direction parallel to the axis thereof, wherein the chock of the lower work roll is constrained to the lower bending block to allow said chock of the lower work roll to perform vertical movements, wherein each of the two upper bending blocks is a different structural element separated from the chock of the upper backing roll and comprises a first part, which forms a vertical sliding coupling with a respective guide fixed on said first housing, and a second part, which forms an element for supporting the chock of the upper backing roll and the chock of the upper work roll, so that the chock of the upper backing roll and the chock of the upper work roll are constrained together to the two upper bending blocks wherein the first shifting device is integrally fixed directly to the two bending blocks of the upper backing roll, by means of structural elements or supporting arms, wherein each second part of the bending block, which forms a support element, is C-shaped with a respective upper projection which is inserted into a lateral groove of the chock of the upper backing roll, to allow a lifting and a lowering of the chock; and wherein the chock of the upper backing roll comprises two lateral support surfaces, arranged at a height greater than that of said lateral groove, which are hooked by two hooks of a balancing crosspiece so that, in the event of a replacement operation of the upper work roll, the balancing crosspiece is not dismounted from the position thereof on the rolling mill stand;

thereby allowing the integral lifting and lowering of the chock of the upper work roll, of the two upper bending blocks and of the first shifting device under load, while the rolling operation is in progress.

2. The rolling mill stand according to claim 1, wherein said vertical sliding coupling is a slide with a T-shaped cross-section, which slides in the respective guide, and is adapted to prevent the bending block from being detached even when the work roll and the respective chock are extracted from the stand.

3. The rolling mill stand according to claim 2, wherein there are provided hydraulic actuators which are capable of reacting against the lower bending blocks and thus capable of transmitting a bending load on the lower work roll.

4. The rolling mill stand according to claim 3, wherein the first horizontal translational movement of the upper work roll occurs between the chock of the upper work roll and the upper bending blocks.

5. The rolling mill stand according to claim 4 wherein the second horizontal translational movement of the lower work roll occurs between the chock of the lower work roll and the lower bending block and is performed under load while the rolling operation is in progress.

6. The rolling mill stand according to claim 5, wherein the lower shifting device is integrally fixed to said first housing or to the respective lower bending block.

* * * * *